US007073555B2

(12) United States Patent
Weddell

(10) Patent No.: US 7,073,555 B2
(45) Date of Patent: Jul. 11, 2006

(54) AWNING SLIDE SYSTEM WITH TRAY

(75) Inventor: Vince Weddell, Irvine, CA (US)

(73) Assignee: Girard Systems, San Clemente, CA (US)

( * ) Notice: Subject to any disclaimer, the term of this patent is extended or adjusted under 35 U.S.C. 154(b) by 63 days.

(21) Appl. No.: 10/844,229

(22) Filed: May 11, 2004

(65) Prior Publication Data

US 2005/0252615 A1 Nov. 17, 2005

(51) Int. Cl.
*E04F 10/00* (2006.01)

(52) U.S. Cl. ..... 160/22; 160/242

(58) Field of Classification Search ..... 160/66, 160/67, 22, 23.1, 242, 29; 248/266, 269, 248/270, 273; 135/88.1, 88.11; 296/163
See application file for complete search history.

(56) References Cited

U.S. PATENT DOCUMENTS 4,164,972 A 8/1979 Bennett
4,641,805 A 2/1987 Martensson, IV
5,192,111 A * 3/1993 Hanemaayer ..... 135/88.1
5,275,483 A 1/1994 Rasmussen
5,333,663 A * 8/1994 Eger ..... 160/22
5,673,739 A * 10/1997 Brutsaert ..... 160/22
6,056,350 A * 5/2000 Brutsaert ..... 296/163
6,142,209 A 11/2000 Girard
6,416,145 B1 7/2002 Singh
6,619,726 B1 9/2003 Jones

FOREIGN PATENT DOCUMENTS

DE 3119776 * 12/1982

* cited by examiner

*Primary Examiner*—Blair M. Johnson
(74) *Attorney, Agent, or Firm*—Walter A. Hackler

(57) ABSTRACT

An awning slide system for a recessed cavity is provided which includes a tray for supporting an awning mechanism with the tray being sized for containment within the cavity which includes an open side for enabling an awning to be retractably extended therefrom. A slide is provided for interconnecting the tray and a cavity surface in order to temporarily expose the awning mechanism outside the recess cavity for providing maintenance access thereto without inhibiting the mechanism from extending from the awing.

14 Claims, 1 Drawing Sheet

AWNING SLIDE SYSTEM WITH TRAY

The present invention generally relates to a roll up awning assembly and is more particularly directed an awning slide system for recessed awning mechanisms.

Conventional awnings have been typically fabricated with an integral structure housing that has been attached to the exterior of houses, offices, boats, trailers, vans, trucks and recreational vehicles. The awning is then typically deployed and retracted from that location.

A disadvantage of a conventional awning assembly is that even when rolled up they protrude from a plane of the vertical wall. This is not aesthetically pleasing and further when attached to a vehicle such awning assemblies will undergo air resistance and often cause undesirable wind noises.

Such a protruding awning assembly is also subject to the accumulation of dirt, such as sand and dust, which can thereafter penetrate into the awning mechanism.

In order to overcome these disadvantages, it is possible to recess the awning assembly or mechanism into a vertical wall such that the mechanism and awning in a rolled up position remain within the wall. However, this arrangement is not amenable to periodic maintenance of the awing mechanism. That is, the awning assembly must be removed from a recessed cavity in order to provide maintenance. This is inconvenient and often difficult, requiring several workers.

The present invention overcomes this disadvantage by providing an awning slide system for a recessed cavity which enables periodic maintenance of the mechanism while maintaining the advantage of a recessed awning and mechanism.

SUMMARY OF THE INVENTION

An awning slide system in accordance with the present invention for a recessed cavity includes a tray for supporting an awning mechanism with the tray being sized for containment within a recessed cavity having an open side for enabling the awning to retractably extend therefrom.

A slide is provided for interconnecting the tray and a cavity surface in order to temporarily expose the awning mechanism outside of the recessed cavity for providing maintenance access thereto without inhibiting the mechanism from extending the awning.

More particularly, the tray may comprise a bottom and an upstanding back and the awning mechanism may be attached to the upstanding back. A slide may be connected to sides of the tray bottom or to a bottom thereof and a bottom of the recessed cavity.

A latch may be provided for releasably securing the tray within the recessed cavity.

BRIEF DESCRIPTION OF THE DRAWINGS

The advantages and features of the present invention may be more clearly understood with reference to the following detailed description when considered conjunction with the appended drawings of which.

DETAILED DESCRIPTION

Figure 1:
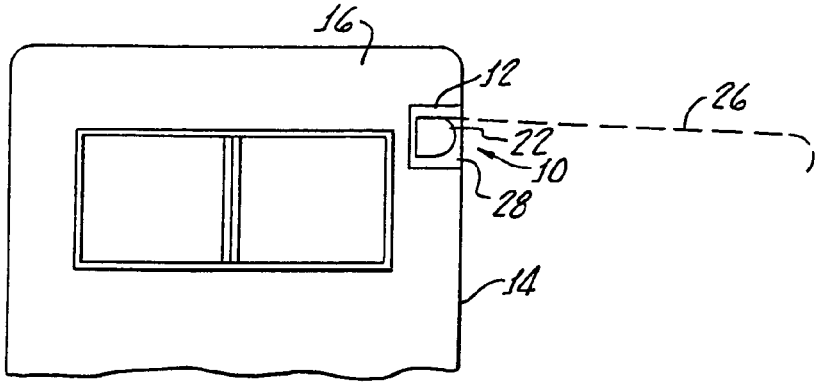
FIG. 1 is a diagram of a side view of an awning mechanism disposed within a recessed cavity with a dashed line showing an extended awning.

With reference to FIG. 1, there is shown an awning slide system 10 in accordance with the present invention for a recessed cavity 12 in a wall 14 of a structure 16. The structure 16 may be a recreational vehicle, boat, house, office, trailer, specialty vehicle, van, truck or any structure where a recessed awning finds utility.

An awning mechanism 22, installed in the cavity 12, is hereinafter described, may be of any suitable type such as, for example, a lateral arm awning set forth in U.S. Pat. No. 4,641,805 to Martensson or a box awning set forth in U.S. Pat. No. 6,142,209 to Girard. These references are incorporated herewith in their entirety by this specific reference thereto for a description of the awning mechanism 22 and accordingly no further description is necessary.

As shown in FIG. 1, the mechanism 22 is operable for retractably extending an awning 26, shown in a dashed line, from an open side 28 of the cavity 12.

Figure 2:
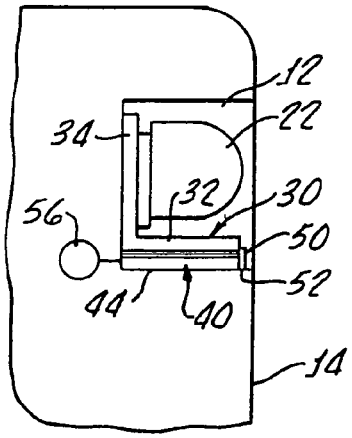
FIG. 2 is an enlarged diagram of the awning mechanism and recessed cavity further showing a tray disposed therein with a slide mechanism.
Figure 3:
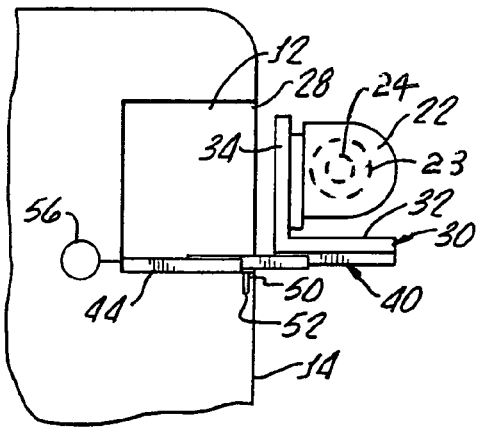
FIG. 3 is a diagram similar to that shown in FIG. 2 showing the slide mechanism exposing a awning mechanism for enabling periodic maintenance.

With reference now to FIGS. 2 and 3, the present invention further includes a tray 30 preferably including a bottom 32 and an upstanding back 34. While the awning mechanism may be attached to either the tray bottom 32 by appropriate brackets, (not shown) it is preferably attached in a conventional manner to the upstanding back 34.

A slide, or slider, mechanism 40 interconnects the tray 30 and a cavity surface, preferably a bottom surface 44 in a conventional manner.

The slide 40 may be attached to sides of the tray bottom 32 or the tray bottom itself.

An example of a side mounted slide is set forth in U.S. Pat. No. 6,416,145 to Singh and a bottom mounted slide is set forth in U.S. Pat. No. 5,275,483 to Rasmussen. These patents are to be incorporated herewith in their entirety by the specific reference thereto for showing the and describing the slide mechanism 40. Accordingly, no further description is necessary.

The slide 40 may include a conventional latch incorporated therein or a separate latch 50 may be provided for releasably receiving the tray 30 within the cavity 12, the latch being accessible through a lever 52 extending from the wall 14.

A motor 56 diagramed in FIGS. 2 and 3 may also be provided to remotely operate the slider in a conventional manner.

A door, not shown, may be also provided to cover the cavity opening 28 also in a conventional manner. As shown in FIG. 3, the slide 40 enables the awning mechanism 22 to be temporarily exposed outside of the recessed cavity 12 for providing maintenance access thereto.

Although there has been hereinabove described a specific awning slide system with tray in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. An awning mechanism and awning slide system in a recessed cavity, said recessed cavity having an open side for enabling the awning to mechanism be retractably extended therefrom, the system comprising:

a tray supporting the awning mechanism, said tray and awning mechanism being contained within the cavity said awning mechanism comprising an awning and operating means therefor; and a slide for slidily moving said tray outside of the cavity in order to temporarily expose the entire said awning mechanism outside of said recessed cavity for providing maintenance access to the roller tube and motor thereto.

2. The slide system according to claim 1 wherein said tray comprises a bottom and an upstanding back.

3. The slide system according to claim 2 wherein said upstanding back is attached to said awning system.

4. The slide system according to claim 3 wherein said slider interconnects the tray bottom with a bottom of said recessed cavity.

5. The slide system according to claim 4 further comprising a latch for releasably receiving said tray within said recessed cavity.

6. An awning mechanism and awning slide system in a recessed cavity, said recessed cavity having an open side enabling said awning mechanism to be retractably extended therefrom, the system comprising:

said awning mechanism, including an awning mechanism and having means, for extending and retracting said awning; and a slider for slidibly moving said awning mechanism outside of the cavity for enabling temporary exposure of the entire said awning mechanism outside of said recessed cavity for providing maintenance access to the roller tube and motor thereto.

7. The slide system according to claim 6 wherein said slider is disposed between a bottom of said awning mechanism and said cavity surface.

8. The slide system according to claim 7 further comprises a latch for releasably securing awning mechanism within said cavity.

9. The slide system according to claim 6 further comprising a tray for supporting said awning mechanism within the cavity and said slide is disposed on said tray.

10. The slide system according to claim 9 wherein said tray comprises a bottom and an upstanding back.

11. The slide system according to claim 10 wherein said awning mechanism is attached to said upstanding back.

12. The slide system according to claim 11 wherein said slider interconnects the tray bottom with a bottom of said recessed cavity.

13. The slide system according to claim 12 further comprising a latch for releasably securing said tray within said cavity.

14. The slide system according to claim 13 further comprises a motor mechanism for sliding said tray.

* * * * *